US008414368B2

(12) United States Patent
Hansen et al.

(10) Patent No.: US 8,414,368 B2
(45) Date of Patent: Apr. 9, 2013

(54) FAN DAMPER

(75) Inventors: Daniel G. Hansen, Holt, MI (US); Christopher Adam Hause, Eaton Rapids, MI (US)

(73) Assignee: Munters Corporation, Mason, MI (US)

( * ) Notice: Subject to any disclaimer, the term of this patent is extended or adjusted under 35 U.S.C. 154(b) by 1447 days.

(21) Appl. No.: 12/017,553

(22) Filed: Jan. 22, 2008

(65) Prior Publication Data

US 2009/0023378 A1 Jan. 22, 2009

Related U.S. Application Data

(60) Provisional application No. 60/886,191, filed on Jan. 23, 2007.

(51) Int. Cl.
*F24F 13/08* (2006.01)

(52) U.S. Cl. ..... 454/351; 454/353; 137/512.1; 137/527

(58) Field of Classification Search ..... 137/512, 137/512.1, 527, 527.6; 251/176, 303; 454/259, 454/338, 347, 351, 352, 353, 358, 359
See application file for complete search history.

(56) References Cited

U.S. PATENT DOCUMENTS

| | | | | |
|---|---|---|---|---|
| 1,023,885 | A * | 4/1912 | Smyth | 137/512.1 |
| 1,164,089 | A * | 12/1915 | Haney | 137/512.1 |
| 2,783,702 | A * | 3/1957 | O'Day | 454/333 |
| 2,976,882 | A * | 3/1961 | Cowan | 137/512.1 |
| 3,095,178 | A * | 6/1963 | Veber | 251/212 |
| 3,334,569 | A * | 8/1967 | Lambie | 454/352 |
| 3,640,306 | A * | 2/1972 | Vogt | 137/512.1 |
| 3,888,166 | A * | 6/1975 | Stottmann | 454/344 |
| 4,094,336 | A * | 6/1978 | Urschel et al. | 137/512.1 |
| 4,269,166 | A * | 5/1981 | Worley et al. | 126/285 R |
| 4,372,196 | A * | 2/1983 | Henderson | 454/349 |
| 4,779,518 | A * | 10/1988 | Artwick et al. | 454/353 |
| 4,896,695 | A * | 1/1990 | Pysh | 137/512.1 |
| 5,222,519 | A * | 6/1993 | Sato et al. | 137/512.1 |
| 5,392,810 | A * | 2/1995 | Cooper et al. | 137/512.1 |
| 6,386,828 | B1 | 5/2002 | Davis et al. | |
| 7,302,962 | B2 * | 12/2007 | Blake et al. | 137/15.18 |
| 7,302,967 | B2 * | 12/2007 | Maeda et al. | 137/512.1 |

(Continued)

FOREIGN PATENT DOCUMENTS

| | | |
|---|---|---|
| JP | 64-005051 | 1/1989 |
| JP | 05-195998 | 8/1993 |
| KR | 20-0203368 | 9/2000 |
| KR | 20-0379928 | 3/2005 |

OTHER PUBLICATIONS

"adjacent." Macmillan Dictionary. www.macmillandictionary.com (Jul. 18, 2012).*
Full page advertisement, Poultry Times, Dec. 2006, IPE 2007 Preview Issue.

*Primary Examiner* — Eric Keasel
*Assistant Examiner* — R. K. Arundale
(74) *Attorney, Agent, or Firm* — Mary M. Moyne; Fraser Trebilcock

(57) ABSTRACT

A damper assembly for use with an axial fan to prevent air from entering the discharge side of the fan when the fan is at idle. The damper assembly includes a damper door having multiple sections. The sections are able to pivot independently in response to the air flow created by the fan to minimize airflow resistance when the fan is operating.

19 Claims, 4 Drawing Sheets

Figure 1:
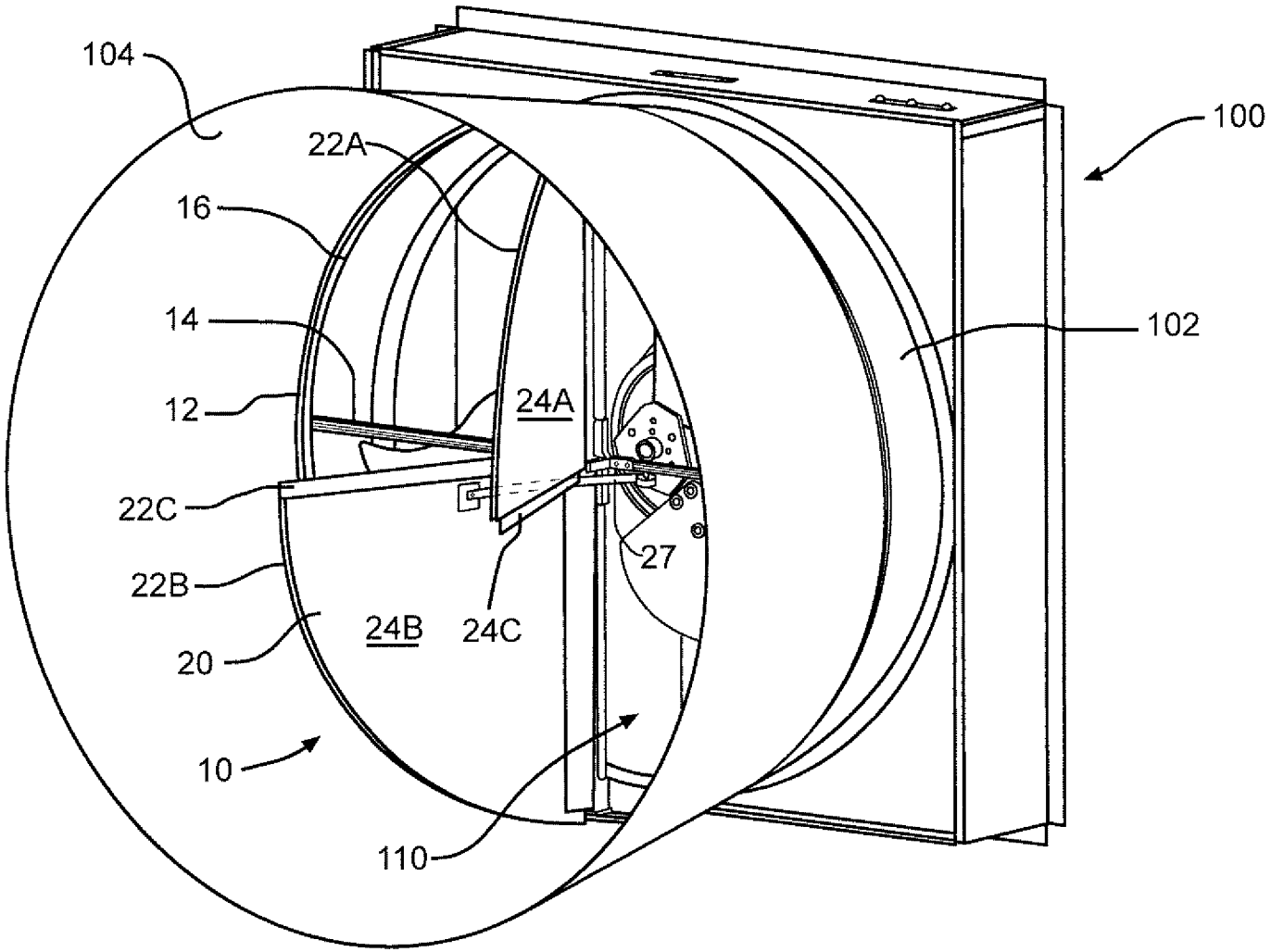

U.S. PATENT DOCUMENTS 7,611,403 B2 * 11/2009 Wenger ..... 454/338
7,695,355 B2 * 4/2010 Doherty ..... 454/76
7,731,477 B2 * 6/2010 Erni ..... 415/126
8,057,161 B2 * 11/2011 Seidler ..... 415/26
2008/0072973 A1 * 3/2008 McGonigle et al. ..... 137/512.1
2011/0116909 A1 * 5/2011 Weisser et al. ..... 415/126

* cited by examiner

FAN DAMPER

CROSS-REFERENCES TO RELATED APPLICATIONS

This application claims the benefit of U.S. Provisional Application No. 60/886,191 filed Jan. 23, 2007.

STATEMENT REGARDING FEDERALLY SPONSORED RESEARCH OR DEVELOPMENT

Not Applicable

BACKGROUND OF THE INVENTION

Field of the Invention

The present invention relates to a damper assembly used to prevent the reverse flow of air into the discharge side of a fan and to prevent conditioned air from escaping a structure. In particular, the present invention relates to a damper assembly for a fan which has sections which pivot freely to reduce interference with the air flow from the fan.

Ventilation systems for buildings that utilize axial fan exhaust systems have typically utilized 'shutter type' dampers on the inlet side of the fan housing or pivoting 'binary flap-type' dampers on the exhaust side of the fan housing to prevent the escape of conditioned air from the building during idle periods. One drawback of the existing 'shutter type' dampers is the decrease in the efficiency of the ventilation system due to the introduction of air-flow resistance bodies within the primary air stream. Another drawback is that it is difficult to provide good sealing of the dampers when closed during idle periods due to the large number of contact areas that require sealing. One drawback of the current 'binary flap-type' damper is the decrease in the efficiency of the ventilation system due to the binary flap doors generating resistance to the air flow by impeding the naturally forming toroidal vortex developed by the axial fan. The 'binary flap-type' dampers also have difficulty in providing good sealing of the dampers when closed during idle periods due to the lack of a seal between the individual doors of the damper.

There remains a need for a high efficiency damper assembly for a fan which does not interfere with the air flow from the fan when the fan is active and which provides good sealing of the damper door when the fan is idle.

BRIEF SUMMARY OF THE INVENTION

A high efficiency multi-door flap type damper assembly for use with an axial fan to prevent the reverse flow of air into the discharge side of the fan. The damper assembly also prevents conditioned air in the building from escaping through the fan. In one (1) embodiment, the damper assembly includes four (4) centrally hinged door sections that seal against each other and against the discharge opening of the fan when the fan is idle. The door sections are able to pivot freely about vertical axes which allow the naturally occurring toroidal vortex created by the propeller of the fan to form along the discharge surfaces of the exhaust duct or discharge cone. In one (1) embodiment, the door sections pivot about a central axis of the fan.

The damper door of the damper assembly is mounted adjacent the discharge side or discharge opening of the fan. The damper door has a left door and a right door. The doors are pivotably mounted along their inner edge and pivot about pivot axes. The pivot axes of the right and left doors may be parallel and may be co-axial. The pivot axes for the doors may be coaxial with the center, vertical axis of the fan. The doors are mounted so that the inner edge of the doors is adjacent the center axis of the fan and the outer edges are adjacent the perimeter of the discharge opening of the fan. The left and right doors are each divided into first and second sections. Each section of the doors is able to pivot independently of the other sections. In the closed position, the sections are essentially in the same plane and cover the discharge opening of the fan. A seal is provided between the outer edges of the doors and the discharge opening. In one (1) embodiment, a frame is provided. The frame is mounted in the discharge opening of the fan. The doors are pivotably mounted on the frame. The seal is provided around the perimeter of the frame where the outer edges of the doors contact the frame.

When the fan is deactivated or idle, the damper door is in the closed position and seals the discharge opening of the fan. When the fan is activated, the left and right doors pivot to an open position. The left door pivots in the counter-clockwise direction and the right door pivots in the clockwise direction. When the fan reaches its steady-state operation or is fully operational, the door sections split and move to an open position which produces very little interference with the flow of air discharged from the fan. In one (1) embodiment, in the open position, when the rotation of the propeller is in the clockwise direction as viewed from the discharge side of the fan, the top sections of the left and right doors are together in the top, right hand quadrant of the discharge opening and the bottom sections of the left and right doors are together in the bottom, left hand quadrant of the discharge opening. Thus, the upper section of the left door pivots a distance of greater than 90° about the pivot axis of the left door while the upper section of the right door pivots a distance of less than 90° about the pivot axis of the right door. Similarly, the lower section of the right door pivots a distance of greater than 90° about the pivot axis of the right door and the lower section of the left door pivots a distance of less than 90° about the pivot axis of the left door. During operation of the fan, the door sections are able to freely pivot in the air flow so as to be able to move as necessary in the air flow to create the smallest amount of interference or disturbances in the airflow. When the fan is deactivated, the doors are automatically pulled to a closed position to seal the discharge opening of the fan. A means for closing the doors is provided.

The present invention relates to a damper assembly for a fan, which comprises a first door pivotably mounted adjacent a discharge side of the fan and configured to pivot about a first axis having a first section and a second section wherein the first section is able to pivot to an open position independent of the second section, and a second door pivotably mounted adjacent the discharge side of the fan and configured to pivot about a second axis having a first section and a second section wherein the first section is able to pivot to an open position independent of the second section.

Further, the present invention relates to a method for preventing air and light from entering a discharge opening of a fan when a fan is deactivated and for allowing unimpeded air flow when the fan is activated, which comprises the steps of providing a damper assembly adjacent the discharge opening of the fan including a first door configured to pivot about a first axis having a first section and a second section wherein the first section pivots to an open position separately from the second section and a second door configured to pivot about a second axis having a first section and a second section, wherein the first section pivots to an open position separately from the second section, and wherein when the fan is deactivated, the doors are in a closed position and the damper assembly covers and seals the discharge opening of the fan, activating the fan wherein air flow created by the fan contacts the first and second doors and pivots the doors into the open position, wherein the first door pivots in a first direction about the first axis and the second door pivots about the second axis in a second direction opposite from the first direction, and wherein in the open position, the first and second sections of each of the doors are at different angles in response to the air flow, and deactivating the fan so that the doors move to the closed position and seal the discharge opening of the fan.

The substance and advantages of the present invention will become increasingly apparent by reference to the following drawings and the description.

BRIEF DESCRIPTION OF THE DRAWING(S)

FIG. 1 is a perspective view of the fan 100 showing the damper assembly 10 in the open position mounted adjacent the discharge opening 110 of the fan 100.

Figure 2:
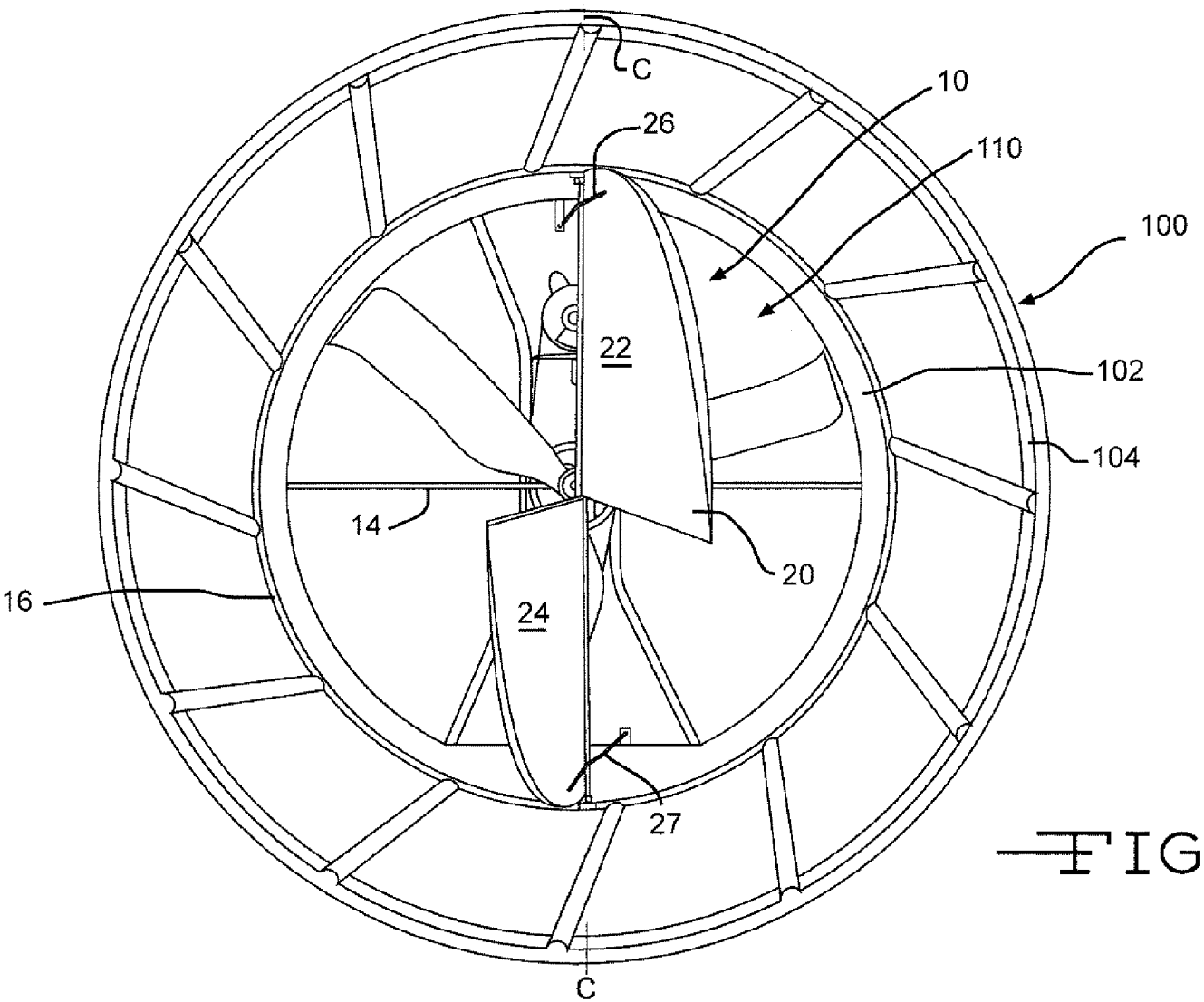

FIG. 2 is a front view of the fan 100 showing the damper assembly 10 with no frame with the damper door 20 in the open position.

Figure 3:
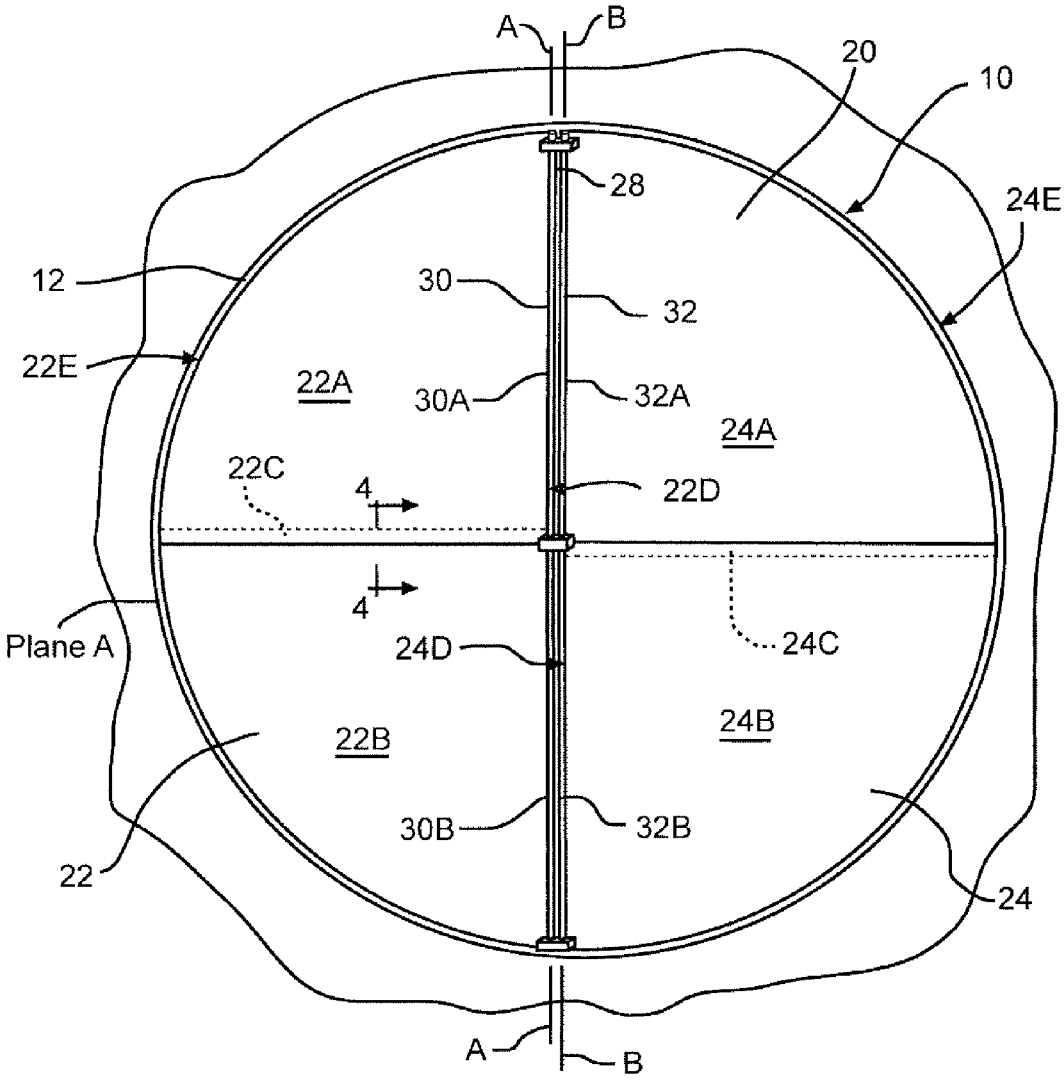

FIG. 3 is a front partial view of the damper assembly 10 with the left and right doors 22 and 24 in the closed position.

Figure 4:
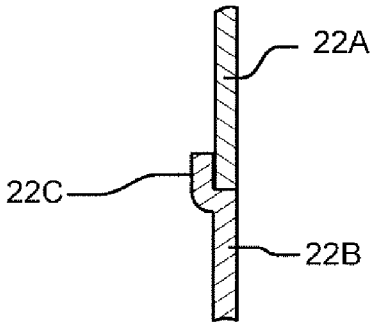

FIG. 4 is a cross-sectional view of FIG. 3 along the line 4-4 showing the tab 22C and the overlap of the upper, first section 22A with the lower, second section 22B of the left door 22.

Figure 5:
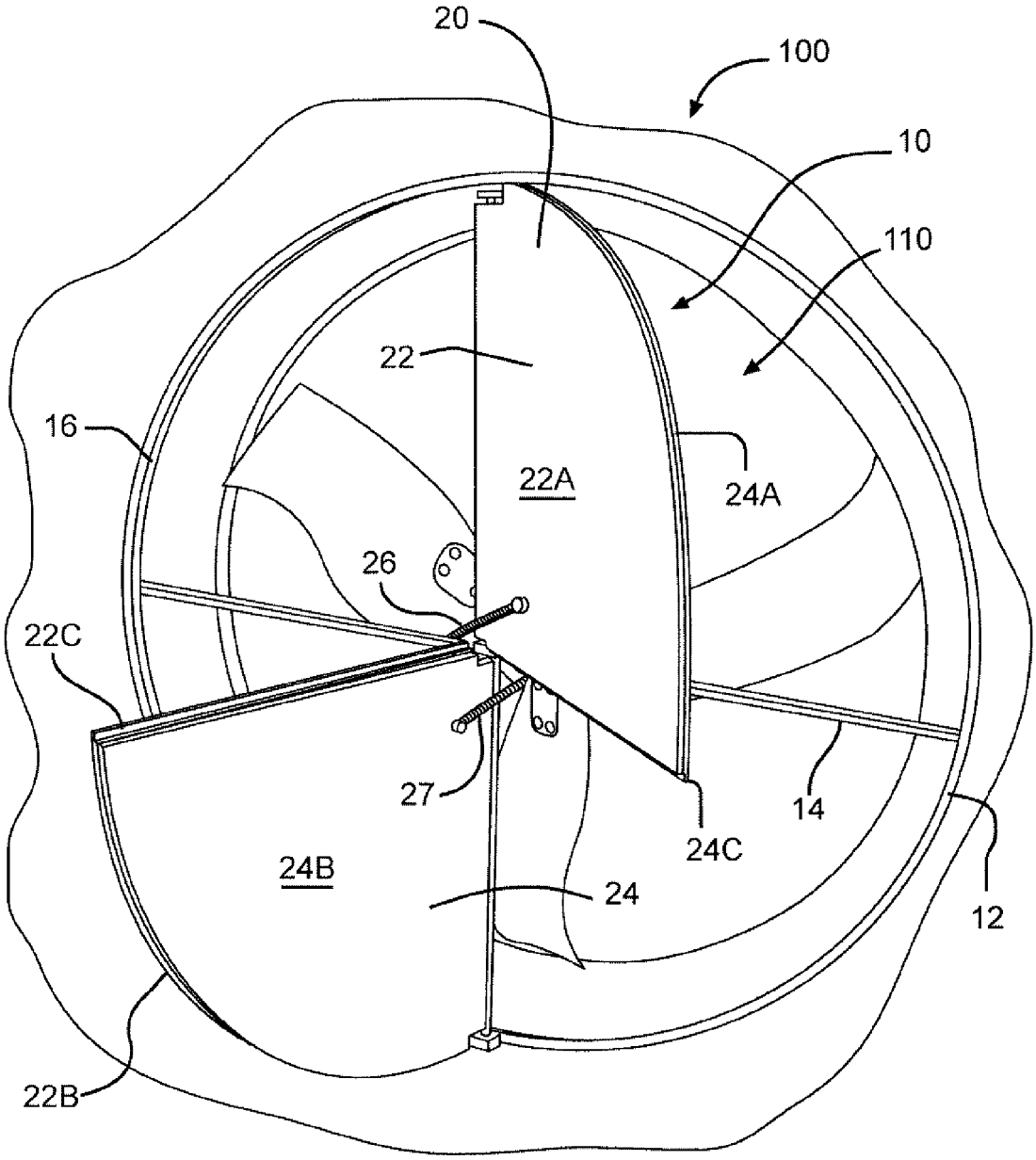

FIG. 5 is a partial perspective front view of the damper assembly 10 with the doors 22 and 24 in the open position.

DETAILED DESCRIPTION OF THE INVENTION

All patents, patent applications, government publications, government regulations, and literature references cited in this specification are hereby incorporated herein by reference in their entirety. In case of conflict, the present description, including definitions, will control.

The present invention relates to a damper assembly 10 for use with an axial fan 100 to prevent air and light from entering the fan 100 and the building and to prevent conditioned air in the building from escaping through the fan 100. The damper assembly 10 is positioned adjacent the discharge or exhaust side of the fan 100. In one (1) embodiment, the damper assembly 10 is mounted in the discharge opening 110 or the discharge cone 104 of the fan 100 (FIG. 1). In one (1) embodiment, the axial fan 100 is similar to the fan described in U.S. Pat. No. 6,386,828 to Davis which is incorporated herein by reference in its entirety.

In one (1) embodiment, the damper assembly 10 includes a frame 12. The frame 12 is mounted adjacent the discharge or exhaust side of the fan 100. In one (1) embodiment, the frame 12 is mounted in the end of the discharge cone 104 of the fan 100 adjacent to the propeller of the fan 100 (FIG. 1). The frame 12 can be mounted to the fan 100 by any means well-known in the art. The shape of the frame 12 depends on the shape of the discharge side or discharge opening 110 of the fan 100. In one (1) embodiment, the frame 12 has a circular shape. The frame 12 can be constructed of any durable, light-weight material. In one (1) embodiment, the frame 12 is constructed of aluminum.

The damper assembly 10 includes a damper door 20 pivotably mounted adjacent the discharge side or discharge opening 110 of the fan 100. The damper door 20 includes a left door 22 and a right door 24 as viewed from the discharge end of the fan 100. The left and right doors 22 and 24 both have an upper, first section 22A or 24A and a lower, second section 22B or 24B. The damper door 20 can have a variety of shapes depending on the shape of the discharge opening 110 of the fan 100. In one (1) embodiment, the damper door 20 has a circular shape. In this embodiment, the left and right doors 22 and 24 each have a semi-circular shape. In one (1) embodiment, the upper and lower sections 22A, 24A and 22B, 24B of the left and right doors 22 and 24 are essentially the same size and shape so that the left and right doors 22 and 24 are essentially bisected or divided in half. The damper door 20 can be constructed of any lightweight durable material. In one (1) embodiment, the damper door 20 is constructed of thin galvanized steel. In another embodiment, the damper door 20 is constructed of plastic.

The left and right doors 22 and 24 are pivotably mounted along an inner edge 22D and 24D in the discharge opening 110 by a hinge 28. In one (1) embodiment, where the discharge opening 110 of the fan 100 has a circular shape, the hinge 28 bisects the discharge opening 110 of the fan 100 vertically. In one (1) embodiment, the hinge 28 is essentially vertical and perpendicular to the ground surface. In one (1) embodiment, the hinge 28 is essentially aligned with the center vertical axis C-C of the fan 100. In one (1) embodiment, the hinge 28 includes a first rod 30 and a second rod 32. The first rod 30 forms a first pivot axis A-A about which the left door 22 pivots and the second rod 32 forms a second pivot axis B-B about which the right door 24 pivots. In one (1) embodiment, the first and second rods 30 and 32 and the first and second pivot axes A-A and B-B are parallel. In one (1) embodiment, the pivot axes A-A and B-B are essentially perpendicular to the ground surface. In one (1) embodiment, the first and second rods 30 and 32 are spaced apart to enable free rotation of the rods 30 and 32. In this embodiment, a seal is positioned between the rods 30 and 32 to prevent air and light from entering or exiting the fan 100 between the rods 30 and 32. In one (1) embodiment, the seal is mounted on an outer sleeve which mounts on the rods 30 and 32. In the one (1) embodiment having the frame 12, the rods 30 and 32 are pivotably connected at each end to the frame 12. In another embodiment, the rods 30 and 32 are connected to the housing 102 or to the discharge cone 104 of the fan 100. In one (1) embodiment, each of the rods 30 and 32 has a first portion 30A and 32A and a second portion 30B and 32B. The first portion 30A and 32A is connected at the first end to the top of the frame 12, the fan housing 102, or discharge cone 104. The second end of the first portion 30A and 32A of the rods 30 and 32 is connected adjacent the first end of the second portion 30B and 32B of the rods 30 and 32. The second end of the second portion 30B and 32B is connected to the bottom of the frame 12, fan housing 102, or discharge cone 104. In one (1) embodiment, a cross member 14 is provided. In the one (1) embodiment having the frame 12, the cross member 14 is part of the frame 12. In another embodiment, the cross member 14 is mounted on the housing 102 or the discharge cone 104 of the fan 100. The cross member 14 extends essentially perpendicular to the first and second pivot axes A-A and B-B. In one (1) embodiment, the cross member 14 bisects the discharge opening 110 of the fan 100. In one (1) embodiment, the second end of the first portion 30A and 32A of the rods 30 and 32 and the first end of the second portion 30B and 32B of the rods 30 and 32 are mounted on the cross member 14. In one (1) embodiment, each of the four portions 30A, 32A, 30B and 32B of the first and second rods 30 and 32 of the hinge 28 is able to pivot and rotate independently. It is understood that the doors 22 and 24 may be pivotably mounted on stationary rods 30 and 32 as opposed to the doors 22 and 24 affixed to pivotably mounted rods 30 and 32. In one (1) embodiment, the first and second portions 30A, 32A, 30B and 32B of the rods 30 and 32 are pivotably connected to the frame 12, housing 102, or discharge cone 104 by bushings.

The inner edges 22D and 24D of the left and right doors 22 and 24 are securely mounted to the rods 30 and 32. The inner edge of the upper, first section 22A of the left door 22 is mounted on the first portion 30A of the first rod 30 and the inner edge of the lower, second section 22B of the left door 22 is mounted on the second portion 30B of the first rod 30. Similarly, the inner edge of the upper, first section 24A of the right door 24 is mounted on the first portion 32A of the second rod 32 and the inner edge of the lower, second section 24B of the right door 24 is mounted on the second portion 32B of the second rod 32. The doors 22 and 24 are mounted so that the inner edge 22D of the left door 22 is adjacent the inner edge 24D of the right door 24. In one (1) embodiment, the hinge 28 includes a single rod forming a single pivot axis about which the doors 22 and 24 pivot. In one (1) embodiment of this embodiment, the single pivot axis is aligned with the vertical center axis C-C of the fan 100. In this embodiment, the inner edges 22D and 24D of the doors 22 and 24 are pivotably mounted on the rod and the rod is securely, affixed on the housing 102, frame 12 or discharge cone 104.

In one (1) embodiment, one section 22A, 22B, 24A or 24B of each door 22 or 24 is provided with a tab 22C or 24C on the edge adjacent the other section 22A, 22B, 24A or 24B of the door 22 or 24. The lower, second section 22B of the left door 22 has a tab 22C along the upper edge adjacent the upper, first section 22A and the upper, first section 24A of the right door 24 has a tab 24C along the lower edge adjacent the lower second section 22B (FIG. 4). The tabs 22C and 24C extend toward the adjacent section 22A or 24B so that the sections 22A and 22B and 24A and 24B contact the adjacent section 22A, 22B, 24A, or 24B when the sections 22A and 22B and 24A and 24B attempt to pivot past each other. The tabs 22C and 24C allow the sections 22A, 22B and 24A, 24B to seal against each other.

A means is provided for moving the doors 22 and 24 into the closed position when the fan 100 is deactivated. In one (1) embodiment, the means is a spring 26 or 27 attached to one (1) section 22A, 22B, 24A or 24B of each door 22 and 24. In one (1) embodiment, a first spring 26 is provided between the frame 12, fan housing 102, or discharge cone 104 and the upper, first section 22A of the left door 22 and a second spring 27 is provided between the frame 12, fan housing 102, or discharge cone 104 and the lower, second section 24B of the right door 24. In one (1) embodiment, one (1) end of the spring 26 or 27 is connected to the cross member 14 and the other end of the spring 26 or 27 is connected to the door section 22A, 22B, 24A or 24B adjacent the cross member 14. The tabs 22C and 24C of the sections 22B and 24A allow a single spring 26 or 27 to be used for each door 22 and 24. The strength of the springs 26 and 27 is such as to prevent the damper door 20 from remaining in the open position when the fan 100 is deactivated while allowing the force of the air discharged from the fan 100 to easily overcome the springs 26 and 27 to open the left and right doors 22 and 24. In one (1) embodiment, the springs 26 and 27 are flat, constant force springs. In another embodiment, the springs 26 and 27 are coil-type extension springs. It is understood that any resilient member may be used in place of the springs 26 and 27. In another embodiment, the means for moving the doors 22 and 24 to the closed position is a mechanical retraction means such as a rack and pinion system, a retraction motor or a solenoid.

A seal 16 is provided between the outer edge 22E and 24E of the doors 22 and 24 and the discharge opening 110 or housing 102 of the fan 100. In the embodiment having the frame 12, the seal 16 is mounted around the outer edge or outer perimeter of the frame 12. The seal 16 is mounted on the side of the frame 12 adjacent the damper door 20. In one (1) embodiment, the seal 16 is integral with the frame 12. In one (1) embodiment, the seal 16 is mounted onto the housing 102 of the fan 100. In another embodiment, the seal 16 is mounted along the outer edges 22E and 24E of the doors 22 and 24. The seal 16 can be constructed of any well-known flexible material which will provide a seal around the outer edges 22E and 24E of the doors 22 and 24, when the damper door 20 is in the closed, at rest position.

In the closed, at-rest position, when the fan 100 is inactive, or idle, the doors 22 and 24 of the damper door 20 are in essentially the same plane A and completely cover the discharge opening 110 of the fan 100 (FIG. 3). In the closed position, the damper door 20 keeps air and light from entering the fan 100 and the building and conditioned air from exiting the building through the discharge side of the fan 100. The seal 16 around the outer edge of the damper door 20 prevents air and light from entering the fan 100 around the outer edge of the damper door 20. The outside air pushes on the outside surface of the door 20 which pushes the damper door 20 against the seal 16 which helps to form a tighter seal. In one (1) embodiment, the housing 102 or frame 12 is provided with magnets which assist in holding the doors 22 and 24 in the closed position.

The damper assembly 10 operates on a pressure differential method. The damper door 20 is positioned near the fan propeller or impeller on the exhaust side of the fan 100. As the fan 100 is engaged or activated, the pressure generated by the motion of the impeller impinges on the inner surface of the damper door 20 causing the left and right doors 22 and 24 of the damper door 20 to swing open. When the fan 100 is activated, the air discharged from the propeller hits the inner surface of the damper door 20 and moves the left and right doors 22 and 24 into the open position. The damper door 20 opens when the air pressure from the propeller contacting the inner surface of the damper door 20 exceeds the retention force of the magnets and the means for moving the doors 22 and 24 to the closed position. The left and right doors 22 and 24 pivot about the pivot axes A-A and B-B. In the embodiment having the pair of rods 30 and 32, the left door 22 pivots at the first rod 30 and the right door 24 pivots at the second rod 32. In one (1) embodiment, the left and right doors 22 and 24 pivot essentially about the vertical axis C-C of the fan 100. The left and right doors 22 and 24 pivot in opposite directions. The left door 22 pivots in the counterclockwise direction and the right door 24 pivots in the clockwise direction as viewed from the discharge opening 110.

In one (1) embodiment, initially, the upper, first section 22A and 24A and the lower, second section 22B and 24B of the left and right doors 22 and 24 open essentially simultaneously. When the left and right doors 22 and 24 reach a position, essentially perpendicular to the propeller, the door sections 22A, 22B, 24A and 24B of the left and right doors 22 and 24 split. At this point, the upper, first sections 22A and 24A of the doors 22 and 24 move together and the lower, second sections 22B and 24B of the doors 22 and 24 move together. In one (1) embodiment, where the propeller rotates in a clockwise direction as viewed from the discharge side of the fan 100, as the door sections 22A, 22B, 24A and 24B move to the open position, the upper, first sections 22A and 24A of the doors 22 and 24 move to the right or to one (1) side of the hinge 28 (FIGS. 1 and 5), and the lower, second sections 22B and 24B of the doors 22 and 24 move to the left or the other side of the hinge 28 as viewed from the discharge side of the fan 100. In one (1) embodiment, the upper, first section 22A of the left door 22 pivots beyond the center axis C-C of the fan 100 and in the open position has an angle of greater than 90° from the closed, at rest position for the upper, first section 22A. In this embodiment, as the upper, first section 24A of the right door 24 moves to the open position, the section 24A pivots back to an angle of less than 90° from the closed, at rest position for the upper, first section 24A. Thus, the upper, first section 22A of the left door 22 is adjacent the upper, first section 24A of the right door 24. In this embodiment, the lower, second section 24B of the right door 24 pivots beyond the center axis C-C of the fan 100, and in the open position, the lower, second section 24B of the right door 24 has an angle greater than 90° from the closed, at rest position for the section 24B. In this embodiment, as the lower, second section 22B of the left door 22 moves to the open position, the section 22B pivots back to an angle of less than 90° from the closed, at rest position for the section 22B. Thus, the lower, second section 24B of the right door 24 is adjacent the lower, second section 22B of the left door 22. Thus, when viewed from the discharge end, the upper sections 22A and 24A of the doors 22 and 24 are in the upper, right quadrant of the discharge opening 110 and the lower, second sections 22B and 24B of the doors 22 and 24 are in the lower, left quadrant of the discharge opening 110. In one (1) embodiment, once the left and right doors 22 and 24 reach the fully open position, the upper, first sections 22A and 24A of the left and right door 22 and 24 are closely adjacent and the lower, second sections of the left and right doors 22 and 24 are closely adjacent. In one (1) embodiment, once the door sections 22A, 24A, 22B and 24B reach a fully open position and make contact, the upper and lower sections 22A, 24A and 22B, 24B remain in contact until the fan 100 is deactivated. It is understood that the position of the door sections 22A, 24A, 22B and 24B depends on the direction of flow of the air coming off the propeller. The position of the tabs 22C and 24C on the correct door sections 22A, 22B, 24A, and 24B must be selected to allow the door sections 22A, 22B, 24A, and 24B to move to the correct position. It is understood that the tabs 22C and 24C are located on opposite sections 22A, 22B, 24A, 24B of the door 22 and 24 so that the upper section 22A or 24A of one door 22 or 24 and the lower section 22B or 24B of the other door 22 or 24 are able to pivot beyond the center axis C-C of the fan 100. It is understood that the position of the tabs 22C and 24C on the upper and lower sections 22A, 22B, 24A and 24B of the left and right doors 22 and 24 depends on the direction of the flow of air off the propeller. Each of the door sections 22A, 22B, 24A and 24B are able to pivot independent of the other door sections 22A, 22B, 24A and 24B. The ability of the door sections 22A, 24A, 22B and 24B to move freely enables the doors 22 and 24 to be moved by the air flow to a position which creates the least amount of interference and resistance in the air flow. The door sections 22A, 22B, 24A and 24B are able to freely pivot so as to follow the angle of the airflow as it moves through the venturi. The door sections 22A, 22B, 24A and 24B are able to float in the air flow created by the propeller and are able to move and adjust as the air flow changes so that that door sections 22A, 22B, 24A and 24B are optimally always in a position to create the least resistance to the air flow. As the fan 100 gains speed and reaches a steady-state operating condition, a toroidal vortex forms along the outer edge of the discharge annulae or opening 110. The individual door sections 22A, 22B, 24A and 24B are allowed to follow the development of the vortex and do not have a major impact on the formation of this phenomenon and thus only have a minimal effect on the efficiency of the fan 100 as a whole. The door sections 22A, 22B, 24A and 24B are able to pivot beyond the center axis C-C of the fan 100 and discharge opening 110. Thus, the door sections 22A, 22B, 24A and 24B are able to pivot beyond the point where the door sections 22A, 22B, 24A and 24B are perpendicular to the propeller. The door sections 22A, 24A, 22B and 24B are allowed to pivot freely about the central vertical axis C-C of the fan 100 thus allowing the naturally occurring toroidal vortex created by the propeller to form along the discharge surfaces of the discharge cone 104.

When the fan 100 is deactivated, the first and second springs 26 and 27 pull on one section 22A, 22B or 24A, 24B of the doors 22 and 24 to automatically return the damper door 20 to the closed, at rest position. As the door section 22A, 22B, 24A or 24B moves to the closed position, the door section 22A, 22B, 24A and 24B contacts the tab 22C and 24C of the horizontally adjacent section 22A, 22B, 24A and 24B and moves the horizontally adjacent section 22A, 22B, 24A and 24B to the closed position. The overlapping of the horizontally adjacent door sections 22A, 22B, 24A and 24B enables a single spring 26 or 27 to be used to close both sections 22A and 22B or 24A and 24B of the door 22 or 24.

The damper assembly 10 is intended to achieve a highly efficient means of providing a reverse flow damper on the exhaust stream of an axial fan system and also prevent light intrusion while maintaining high air flow rates when the damper assembly 10 is open. The damper assembly 10 is generally applicable to the agricultural field that utilizes large axial fans, in the range of 36 inch (914 mm) to 55 inch (1,397 mm) diameter, to provide exhaust ventilation for large buildings. However, it is understood that the damper assembly 10 can also be used in smaller and larger fans for other uses. The damper assembly 10 is particularly useful in applications that are sensitive to heat losses and light intrusion that must be controlled in the ventilation system. However, it will be appreciated by those skilled in the art that the damper assembly 10 has broader application and could be utilized in other applications where high efficiency airflow is required.

The performance of the fan 100 having the damper assembly 10 was tested. The results are set forth in Table 1. Table 1 also shows the volume of air in cubic feet per minute (CFM) produced by the fan 100 as compared to a fan with binary 'flap-type' damper. The test was conducted on an axial fan having a 50 inch (1,270 mm), three (3) blade fan using a FM1024 AOS 181416 motor. The propeller was constructed of galvanized steel. The drives included a AK35/MEM standard prop sheave and an A85K belt with tensioner set to 1.5 marks. The damper assembly 10 was mounted in the extended cone. A guard with three (3) inch (76 mm) wire spacing was also provided in the cone. A 2 inch×2 inch (51 mm×51 mm) mesh guard was provided on the inlet. The average temperature, wet bulb (W.B.) was approximately equal to 55.0° F. (13° C.) and the average temperature, dry bulb (D.B.) was approximately equal to 76.0° F. (24° C.). The recorded barometric pressure (B.P.) was equal to 29.61 and the corrected B.P. was equal to 29.48.

TABLE 1

| Static Pressure | | Standard Airflow | | | | | | Airflow Efficiency | | % increase in |
|---|---|---|---|---|---|---|---|---|---|---|
| | | | | | | | | CFM/ | $m^3/h$/ | airflow vs. binary |
| in. $H_2O$ | Pa | CFM | $m^3/h$ | RPM | Volts | Amps | Watts | Watt | Watt | 'flap-type' damper |
| 0.00 | 0.00 | 26,376 | 44,839 | 451 | 229.8 | 5.20 | 1127 | 23.4 | 39.8 | 4.0% |
| 0.05 | 12.5 | 24,667 | 41,934 | 450 | 230.5 | 5.34 | 1165 | 21.2 | 36.0 | 7.6% |
| 0.10 | 25.0 | 22,767 | 38,704 | 449 | 230.5 | 5.51 | 1202 | 18.9 | 32.1 | 10.4% |
| 0.15 | 37.5 | 20,588 | 35,000 | 448 | 230.4 | 5.65 | 1231 | 16.7 | 28.4 | 14.8% |
| 0.20 | 50.0 | 17,991 | 30,585 | 447 | 229.9 | 5.79 | 1257 | 14.3 | 24.3 | 20.6% |
| 0.25 | 62.5 | 14,420 | 24,514 | 447 | 230.3 | 5.83 | 1272 | 11.3 | 19.2 | 29.5% |
| 0.30 | 75.0 | 10,060 | 17,102 | 446 | 230.4 | 5.83 | 1272 | 7.9 | 13.4 | 17.1% |

AFR = 0.73

The testing shows that a fan 100 having a damper door 20 that has four (4) independently pivoting sections 22A, 22B, 24A and 24B has an airflow between about four percent (4%) and about thirty percent (30%) greater than a fan having a binary 'flap-type' damper.

It is intended that the foregoing description be only illustrative of the present invention and that the present invention be limited only by the hereinafter appended claims.

What is claimed is:

1. A damper assembly for a fan, which comprises:

a) a first door pivotably mounted adjacent a discharge side of the fan and configured to pivot about a first axis, the first door having a first section and a second section with the first section able to pivot to an open position independent of the second section; and b) a second door pivotably mounted adjacent the discharge side of the fan and configured to pivot about a second axis, the second door having a first section and a second section with the first section able to pivot to an open position independent of the second section, the first and second doors essentially forming a plane in a closed position wherein in the open position, the first section of the first door is at an angle greater than 90° from the closed position of the first door and in an open position, the second section of the first door is at an angle of less than 90° from the closed position of the first door.

2. The assembly of claim 1 wherein in the open position, the first section of the second door is at an angle of less than 90° from the closed position of the second door and the second section of the second door is at an angle of greater than 90° from the closed position of the second door.

3. The assembly of claim 1 wherein a means for moving the first door into the closed position is connected to the first section of the first door and wherein a means for moving the second door into the closed position is connected to the second section of the second door.

4. The assembly of claim 3 wherein the second section of the first door has a tab adjacent the first section of the first door which contacts the first section of the first door and wherein the first section of the second door has a tab adjacent the second section of the second door which contacts the second section of the second door.

5. The assembly of claim 1 wherein the first door is pivotably mounted on an inner edge and the second door is pivotably mounted on an inner edge and wherein the inner edge of the first door is adjacent the inner edge of the second door.

6. The assembly of claim 1 wherein a frame is configured to be mounted adjacent the discharge side of the fan and wherein the first and second doors are pivotably mounted on the frame.

7. The assembly of claim 1 wherein the first and second doors are bisected so that the first section of each door is essentially equal in size and shape to the second section of each door.

8. The assembly of claim 1 wherein a seal is provided adjacent an outer edge of the doors and wherein the seal provides a seal between the discharge side of the fan and the doors.

9. A damper assembly for a fan, which comprises:

a) a first door pivotably mounted adjacent a discharge side of the fan and configured to pivot about a first axis, the first door having a first section and a second section with the first section able to pivot to an open position independent of the second section; and b) a second door pivotably mounted adjacent the discharge side of the fan and configured to pivot about a second axis, the second door having a first section and a second section with the first section able to pivot to an open position independent of the second section, in the open position, the first section of the first door is in contact with the first section of the second door and the second section of the first door is in contact with the second section of the second door.

10. A damper assembly for a fan, which comprises:

a) a first door pivotably mounted adjacent a discharge side of the fan and configured to pivot in a counter-clockwise direction about a first axis, the first door having a first section and a second section with the first section able to pivot to an open position independent of the second section; and b) a second door pivotably mounted adjacent the discharge side of the fan and configured to pivot in a clockwise direction about a second axis, the second door having a first section and a second section with the first section able to pivot to an open position independent of the second section.

11. The assembly of claim 10 wherein the first and second axes are parallel.

12. The assembly of claim 10 wherein the first and second axes are co-axial.

13. The assembly of claim 10 wherein the first and second axes are essentially perpendicular to a ground surface.

14. A damper assembly for a fan, which comprises:

a) a frame configured to be mounted adjacent the discharge side of the fan;

b) a first door pivotably mounted on the frame by a first rod, and configured to pivot about a first axis, the first rod having a first portion and a second portion, the first door having a first section connected to the first portion of the first rod and a second section connected to the second portion of the first rod, with the first section able to pivot to an open position independent of the second section; and c) a second door pivotably mounted on the frame by a second rod and configured to pivot about a second axis, the second rod having a first portion and a second portion, the second door having a first section connected to the first portion of the second rod and a second section connected to the second portion of the second rod with the first section able to pivot to an open position independent of the second section.

15. The assembly of claim 14 wherein each rod and each portion of each rod pivot independently.

16. The assembly of claim 14 wherein the rods are parallel and spaced apart and a seal is provided between the rods.

17. A damper assembly for a fan, which comprises:

a) a frame configured to be mounted adjacent a discharge side of the fan;

b) a first door pivotably mounted on the frame and configured to pivot about a first axis, the first door having a first section and a second section with the first section able to pivot to an open position independent of the second section;

c) a second door pivotably mounted on the frame and configured to pivot about a second axis, the second door having a first section and a second section with the first section able to pivot to an open position independent of the second section; and d) a seal provided on the frame so that when the doors are in a closed position, an outside edge of the doors contacts the seal and provides a seal between the doors and the frame.

18. A damper assembly for a fan, which comprises:

a) a first door having a semicircular shape pivotably mounted adjacent a discharge side of the fan and configured to pivot about a first axis, the first door having a first section and a second section with the first section able to pivot to an open position independent of the second section; and b) a second door having a semicircular shape pivotably mounted adjacent the discharge side of the fan and configured to pivot about a second axis, the second door having a first section and a second section with the first section able to pivot to an open position independent of the second section.

19. A damper assembly for a fan, which comprises:

a) a first door pivotably mounted adjacent a discharge side of the fan and configured to pivot about a first axis co-axial with a vertical, center axis of the fan, the first door having a first section and a second section with the first section able to pivot to an open position independent of the second section; and b) a second door pivotably mounted adjacent the discharge side of the fan and configured to pivot about a second axis co-axial with the vertical, center axis of the fan, the second door having a first section and a second section with the first section able to pivot to an open position independent of the second section.

* * * * *